US005431175A

United States Patent [19]

Beckett et al.

[11] Patent Number: 5,431,175

[45] Date of Patent: Jul. 11, 1995

[54] PROCESS FOR CONTROLLING WET BULB TEMPERATURE FOR CURING AND DRYING AN AGRICULTURAL PRODUCT

[76] Inventors: John M. Beckett, 154 Hill La., Ellenwood, Ga. 30049; Larry J. Livingston, 4768 Hermitage Rd., Virginia Beach, Va. 23455

[21] Appl. No.: 186,611

[22] Filed: Jan. 26, 1994

[51] Int. Cl.[6] ..... A24B 3/04

[52] U.S. Cl. ..... 131/303; 131/300

[58] Field of Search ..... 131/300, 302, 303; 34/34, 43, 50; 426/235, 263, 465, 467

[56] References Cited

U.S. PATENT DOCUMENTS

| | | | |
|---|---|---|---|
| 3,840,025 | 10/1974 | Fowler et al. | 131/303 |
| 3,905,123 | 9/1975 | Fowler et al. | 131/303 X |
| 4,192,323 | 3/1980 | Horne | 131/303 |
| 4,434,563 | 3/1984 | Graalmann et al. | 131/303 X |
| 4,709,708 | 12/1987 | Kagawa | 131/303 X |
| 4,723,560 | 2/1988 | Kagawa | 131/303 X |
| 4,788,989 | 12/1988 | Nambu et al. | 131/303 |
| 4,836,222 | 6/1989 | Livingston | 131/300 |
| 5,125,420 | 6/1992 | Livingston | 131/302 |

*Primary Examiner*—Jennifer Bahr

*Attorney, Agent, or Firm*—Rhodes, Coats & Bennett

[57] ABSTRACT

The present invention entails a process for curing and drying tobacco and other related agricultural products. A three-mode controller having proportional, integral and derivative functions is utilized to actuate an inlet damper associated with a curing and drying structure. In order to compensate for outside environmental changes and dynamic changes within the structure, a proportional, integral and derivative tuning module is provided which continues to tune and establish new proportional, integral and derivative functions as the curing and drying process is moved up a temperature ramp.

8 Claims, 5 Drawing Sheets

PROCESS FOR CONTROLLING WET BULB TEMPERATURE FOR CURING AND DRYING AN AGRICULTURAL PRODUCT

BACKGROUND OF THE INVENTION

Tobacco curing and drying basically involves three phases or stages. First, there is the curing or yellowing stage where the tobacco leaf material is treated and conditioned prior to leaf drying. After curing or yellowing, the tobacco leaf is subjected to a drying period. Once the leaf has been dried then the final stage of the process entails drying the stems of the leaf material.

In order to produce high quality tobacco it is absolutely essential that the tobacco farmer carry out an effective curing or yellowing process. During this part of the curing and drying process, the rate that moisture is removed from the leaf is very critical. Prior to being placed in a tobacco curing and drying structure, the tobacco leaf includes a very substantial moisture content and as a part of curing and drying, the process entails continuously and systematically removing moisture from the tobacco leaf over an extended period of time. The tobacco leaf includes what is referred to as stomata and the moisture held within the leaf escapes or migrates through the stomata of the leaf. It has long been known and appreciated that the appropriate curing and drying rate of tobacco is controlled by maintaining a certain relationship between dry bulb and wet bulb conditions within the curing and drying structure. Dry bulb temperature is defined as the temperature of the air within the curing and drying structure during the process. Wet bulb temperature is defined as the temperature of a thermometer within the same curing and drying structure with the thermometer being embedded within a wet wick. During the curing and drying process, forced air is moved by the tobacco leaf material and during the process a moisture gradient is established between the leaf and the air and consequently, moisture flows from the leaf to the air. As additional moisture is added to the air, the wet bulb temperature of the air increases. It follows that if sufficient moisture is not removed from the air, that the wet bulb temperature will continue to rise until an equilibrium stage is realized and no further moisture is removed from the leaf.

In order to maintain an appropriate environment for continually removing moisture from the tobacco leaf, it becomes necessary throughout the process to continuously mix fresh outside air, which contains less moisture, with the air inside the tobacco curing and drying structure. During this process a certain quantity of high humidity air will be forced out the exhaust dampers of the curing and drying structure. This will have the effect of reducing the wet bulb temperature within the structure. It then follows that when the amount of moisture removed from the structure is equal to the amount of moisture removed from the tobacco leaf material then the wet bulb temperature will remain constant and ideal curing conditions will exist.

In the past, many farmers have set the inlet and exhaust dampers of the curing and drying structure manually. Past results of farmers indicate that it is virtually impossible to precisely manually set the dampers of a curing and drying structure. The result is that manual damper settings create an imbalance between leaf moisture loss and the structure moisture loss. This of course means that the wet bulb temperature will vary over a period of time and will deviate from a desired set point.

It has been known to automatically control the dampers of a tobacco curing and drying structure and to attempt to maintain a proper relationship between wet bulb and dry bulb temperatures within a curing and drying structure. In fact, it is known to utilize a three-mode controller for controlling the damper position of the inlet to the curing and drying structure. However, the real problem presented with a three-mode controller is that the conditions within the structure and the conditions outside the structure are continuously changing. This is a problem because a conventional three-mode controller is set based on conditions within the structure and conditions outside of the structure remaining constant. It is certainly appreciated that the conditions outside the curing and drying structure change and consequently, the fresh outside air that is brought into the structure will vary in moisture content from time to time. By the same token, the leaf conditions change throughout the cure or throughout the process and that in turn effects a change in the internal environment. Consequently, a conventional three-mode controller attempts to maintain a certain wet bulb condition within the curing and drying structure based on continuously changing internal and external conditions. The net result is that it is virtually impossible to continuously accurately control the wet bulb conditions within a tobacco curing and drying structure without continuously changing the control parameters relative to the inside and outside conditions.

Therefore, there is and continues to be a need in the tobacco curing and drying field and in the fields of curing and drying other related agricultural products, for a control system that continuously monitors inside and outside conditions and varies key control parameters such that they respond to such changing conditions to effectuate a precise controlled environment.

SUMMARY AND OBJECT OF THE INVENTION

The present invention relates to a method and system for curing or drying tobacco and other agricultural products. In particular, the present invention relates to a system and method for controlling the wet bulb temperature within a curing and drying structure especially during a curing phase which in the case of tobacco is also referred to as "yellowing". In the case of the present invention, a three-mode controller is provided for controlling the inlet damper associated with the curing and drying structure. This three-mode controller effectively controls the quantity or amount of air exhausted from the drying structure and the amount of air induced or brought into the drying structure. Consequently, by continuously exhausting air from the structure and inducing fresh outside air into the structure, the humidity within the structure or the wet bulb temperature can be controlled so as to optimize curing or drying within that structure. To compensate for dynamic changes with respect to the material being cured and dried within the structure and to compensate for outside environmental changes, the present invention will entail a curing and drying process where various important control parameters for the damper control are continuously tuned and updated to reflect changes inside and outside of the structure. As noted above, the present invention entails a process and a system that utilizes a three-mode damper controller, the three-modes being proportional, integral, and derivative. These three parameters, proportional, integral, and derivative are continuously tuned and updated as the curing and drying process moves up a temperature ramp such that over a period of curing and drying time the proportional, integral and derivative values will be changed and updated and these changes will be inputted into the damper controller and the damper will be accordingly controlled.

It is therefore an object of the present invention to provide an improved curing process for tobacco and other related agricultural products utilizing a three-mode damper controller that is based on proportional, integral and derivative parameters wherein these very three parameters are continuously tuned and updated while the curing process is ramped up a wet bulb temperature schedule.

Still a further object of the present invention is to provide a three-mode controlled tobacco curing process entailing proportional, integral and derivative parameters that is responsive to dynamic changes to the crop material being cured or dried and the environment within the curing and drying structure as well as environmental changes (particularly humidity) of outside air that is induced into the structure to maintain an appropriate curing and drying environment within that structure.

Another object of the present invention is to provide a reliable and effective damper control system for a tobacco curing and drying structure that will precisely control wet bulb temperature over a curing period irrespective of outside environmental changes and despite internal environmental changes within the curing and drying structure.

Another object of the present invention resides in the provision of a control system for an agricultural curing process that is effective to reinstate a previous wet bulb temperature in the event of a power failure when power is in fact re-established.

A further object of the present invention resides in the provision of a method and system for controlling the curing and drying of tobacco and other related agricultural crops that include a provision for continuously monitoring wet bulb temperature and emitting an alarm signal at any time the wet bulb temperature is outside of a selected range.

Other objects and advantages of the present invention will become apparent and obvious from a study of the following description and the accompanying drawings which are merely illustrative of such invention.

DETAILED DESCRIPTION OF THE INVENTION

Figure 1:
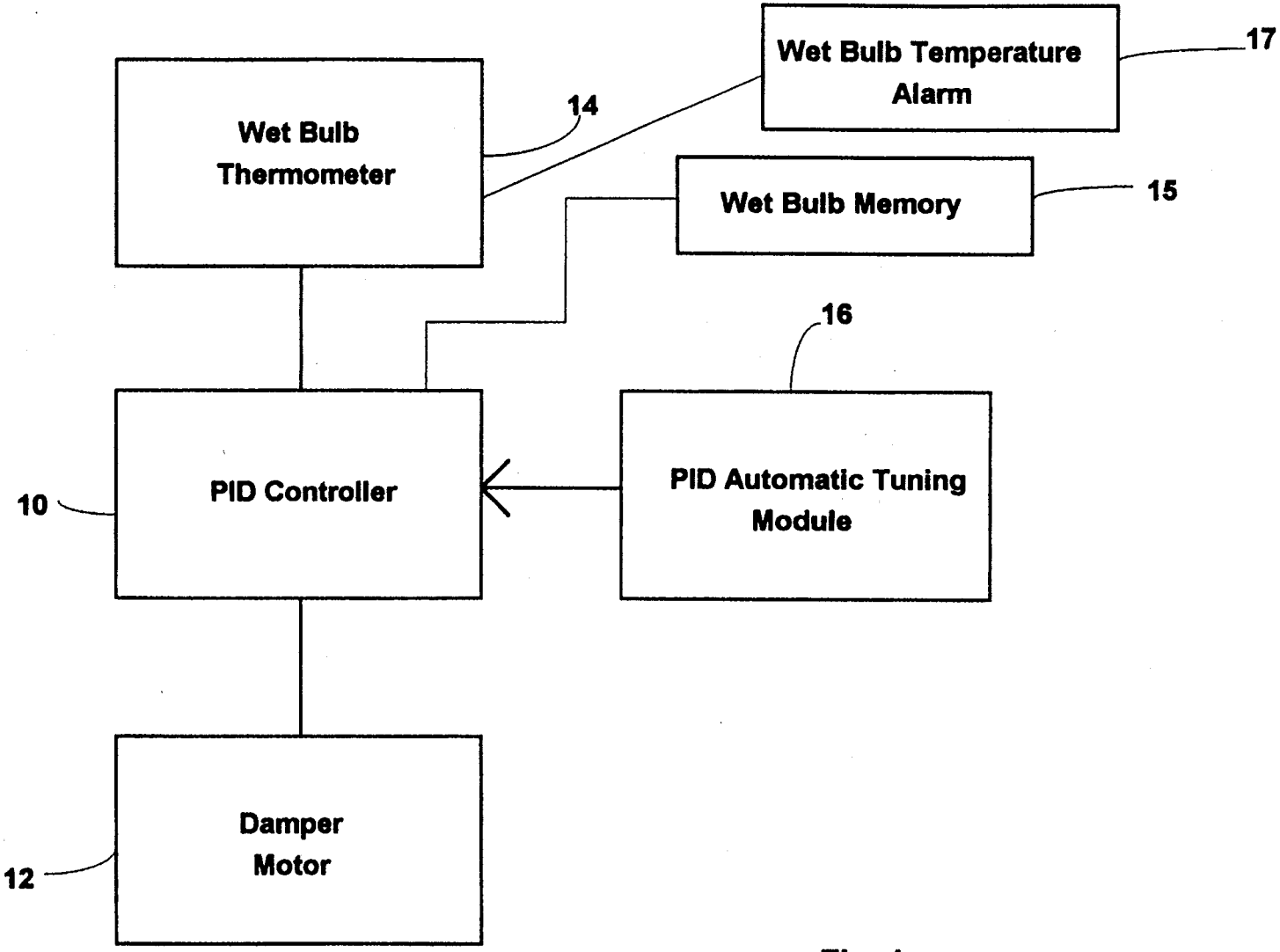
FIG. 1 is a schematic view illustrating the basic components for the three-mode control system of the present invention.

The present invention relates to a curing and drying process for an agricultural product such as tobacco. In this specification and discussion, a tobacco curing and drying process and a control system therefore will be disclosed. However, it will be appreciated that the present invention is applicable to other agricultural products that are subjected to curing and drying.

Before proceeding with a detailed discussion of the curing and drying process of the present invention, it may be beneficial to basically review the curing and drying of flue-cured tobacco. Tobacco is harvested from the field and transported to a bulk tobacco barn or curing and drying structure. The tobacco is housed within the barn in large bulk racks or in single tier racks. The tobacco is cured and dried by circulating air vertically through the tobacco disposed within the curing and drying structure. A furnace system is associated with the curing and drying structure and is adapted to force air into the structure and through the tobacco leaf material and to add heat as necessary in order to maintain optimum curing and drying conditions within the structure. Because moisture is being continuously removed from the leaf or product material, it is important to continuously or periodically induce fresh outside air while at the same time exhausting moisture laden air from the curing and drying structure. As is appreciated by those skilled in the art of curing and drying, it is particularly important to the curing and drying process of tobacco or any other agricultural products to control the humidity conditions within the curing and drying structure by maintaining control over the quantity of fresh outside air brought into the structure. In the case of tobacco, it is important to control the relative humidity within the curing and drying structure by controlling the amount of fresh outside air brought in or induced into the curing and drying structure.

Curing and drying flue-cured tobacco basically involves three phases or stages. First, there is the curing or "yellowing" phase where the farmer attempts to establish and set a desirable color in the tobacco leaf material. Although there are various yellowing schedules that farmers follow and also yellowing schedules can vary depending upon the type of crop involved and a host of other variables, a basic curing or yellowing schedule would entail beginning the process at approximately 90° F. dry bulb temperature and advancing the dry bulb temperature up a ramp to approximately 105° F. at 1 degree per hour. This would of course require a 15 hour time period. Again, the length of the curing or yellowing period can vary depending upon the condition and type of tobacco material being cured and other factors as well.

The next basic step in the process is referred to as leaf drying. It should be noted that some tobacco farmers and other people skilled in the tobacco curing art may refer to a wilting process that is interposed between yellowing and leaf drying. In a wilting process basically the leaf is wilted after yellowing and prior to leaf drying. In any event, leaf drying is one of the three major phases of curing and drying tobacco and this phase ordinarily follows the curing or "yellowing" phase.

Once the leaf has been dried, the final stage of the tobacco curing and drying process entails stem drying. There the dry bulb temperature is advanced to a relatively high degree, approximately 170° F., and maintained there at over a substantial period of time in order to dry and remove the moisture from the tobacco stems.

The present invention deals with precisely controlling the inside humidity of the curing and drying structure during the curing and drying process. It is known in the tobacco curing and drying art and other related agricultural product drying arts that favorable curing and drying conditions can be maintained within a structure by controlling wet bulb temperature within the structure. More particularly, critical humidity conditions can be maintained and controlled by maintaining a selected relationship between dry bulb and wet bulb temperatures within a curing and drying structure. This is born out by an appreciation of a psychometric chart. It is not too difficult to control dry bulb temperature within a curing and drying structure. However, it is much more difficult to control the wet bulb temperature within a curing and drying structure because the process requires the continuous exhausting of moisture laden air while at the same time bringing in fresh outside air into the same curing and drying structure. It is the continuous inducement of fresh outside air into the structure and the continuous exhaust from the curing and drying structure that makes it difficult to maintain and control wet bulb temperature and to accordingly control the humidity conditions within the curing and drying structure.

The present invention entails a three-mode controller system for continuously controlling the quantity of fresh outside air induced into the curing and drying structure as well as the quantity of air exhausted from the curing and drying structure.

To control the wet bulb temperature within the curing and drying structure of the present invention, a three-mode controller 10 is connected to a damper motor 12 which is in turn connected to the inlet damper of the curing and drying structure. In addition, the three-mode controller 10 is connected to a wet bulb thermometer 14 which is operative to sense wet bulb temperature within the curing and drying structure and to communicate the sensed wet bulb temperature to the three-mode controller 10. Controller 10 in turn is operative to actuate the damper motor 12 and to accordingly control the quantity of fresh outside air that is induced into the curing and drying structure.

Controller 10 is a three-mode controller and basically utilizes conventional proportional, integral and derivative control functions or parameters to actuate the damper motor 12.

Briefly, a discussion of a proportional, integral and derivative parameters will be set forth in order to provide for a more unified understanding of the basic control parameters utilized by the controller 10 to actuate the damper motor 12. In this regard, the first parameter utilized by the controller 10 is referred to as a proportional control. Controller 10 includes a span which is defined as the difference between high and low set points. Controller 10, for example, would include a high set point of 212° F. and a low set point of 32° F. This yields a span of 180° F. Controller 10 can provide an output signal for any damper position between 0% and 100% open. The proportional band is the percentage of the span the controller operates between open and closed. Thus, using a 10% proportional band the controller will change from an open position to a closed position in 18° F. If a set point of 105° F. is established then it follows that the output of the controller 10 will 50% at 105° F., 100% at 96° F., and 0% or closed at 114° F. Expressed in another way, at a 105° F. wet bulb temperature the damper motor will be actuated such that the damper is 50% open. At this position, if the damper opening is too wide, the wet bulb temperature will drop inside the structure. As the wet bulb temperature drops the damper will close more than 50%. At some point, the system will stabilize with a constant wet bulb temperature. The damper opening required for this will probably not be at the original set point. For example, the controller may have to be set at 107° F. in order to maintain an actual 105° F. wet bulb temperature within the structure. This is called "offset" and is inherent with all proportional controls.

It should be pointed out that the damper operation is not in fact linear. The basis of proportional control is that at a 50% output the amount of the damper opening is one-half of what it is at 100% output. That is not the case with a conventional damper design. This is because the damper mechanism is hinged and operates in an arcuate fashion. Because of this, the effective open area of the damper does not vary linearly with the controller.

Because of the above, and particularly to compensate for the offset in a proportional control system, an integral function is introduced. This integral function or parameter tends to reduce the offset of the total control system. The output will be changed by an amount required to allow the controller 10 to maintain the proper set point without having to adjust the controller up or down. It should be pointed out however, that this integral control function does not compensate for the nonlinear operation of the damper.

The third basic control parameter that forms a part of the controller 10 and its associated control system is the derivative function or parameter. In a stable system there would be no requirement for a derivative function. However, the curing and drying process in tobacco and other agricultural products is not stable. If the controller 10 makes a small adjustment there is a corresponding change in the controlled temperature. The purpose of the derivative function is to measure how fast the temperature rises and adjusts the damper position in addition to the proportional and integral functions.

In cases where outside conditions require that an opening of 25% in the damper is required, the reset will change the output level so that the controller 10 will be at 25% at the set point. Since the damper opening is not linear the response of the curing and drying structure temperature will be different in one direction than in the other direction. This results because the damper opening varies with the sine of the damper angle. The derivative function measures the rate of change and adjusts the damper accordingly. This same control phenomena occurs when outside environmental conditions change. When outside conditions change a response to an incremental change in damper position will of course be different. The derivative function inherent within the PID controller 10 will cause the damper to open the proper amount based on the change in the rate of increase.

During the curing phase of a product such as tobacco, the proportional, integral and derivative functions or parameters may be continuously tuned and updated so as to compensate for dynamic changes within the structure as well as environmental changes outside of the structure.

The present invention entails a PID automatic tuning module 16 that is operatively associated with the PID controller 10 for continuously tuning and updating proportional, integral and derivative functions throughout the curing process. That is, the tuning module 16 continues to monitor conditions within and outside of the structure so as to continuously develop new proportional, integral, and derivative functions that are utilized by the PID controller 10 to effectively control the wet bulb temperature within the curing structure.

Figure 2:
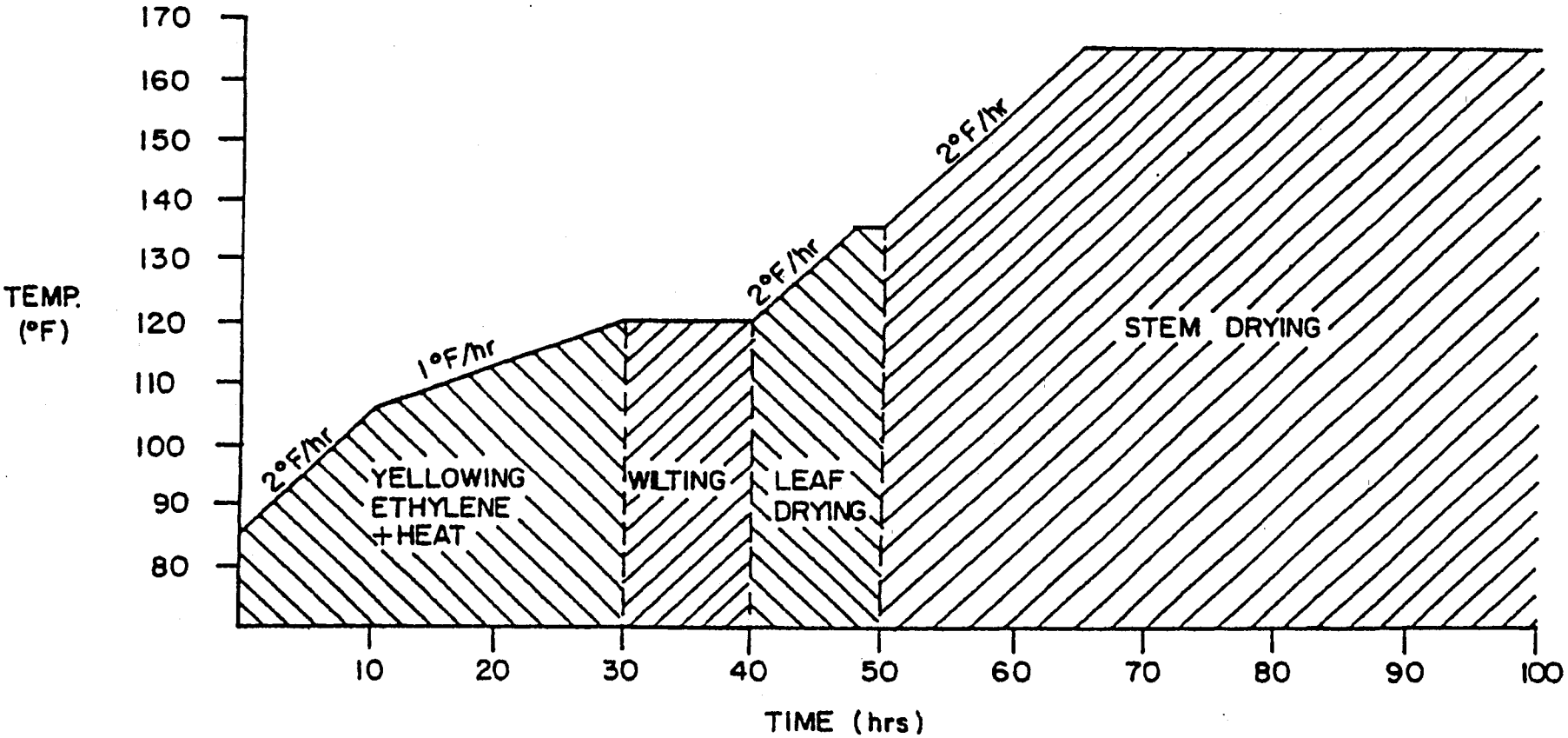
FIG. 2 is a graphic illustration of a tobacco curing and drying schedule.

As seen in FIG. 2, there is shown therein a curing or yellowing schedule for flue-cured tobacco. It is noted that the process begins at 85° F. wet bulb and extends upwardly to about 105° F. wet bulb at 2° per hour. Then the process continues to 120° F. at 1° F./hour. Consequently, the yellowing curing process of FIG. 2 is scheduled for a thirty hour period. During this entire curing or yellowing process, the wet bulb temperature within the curing and drying structure is being ramped upwardly from 85° F. to 120° F. The present control system and the process disclosed herein, contemplates that new proportional, integral and derivative values will be continually determined throughout this curing schedule. Thus, it is appreciated that as the temperature is ramped up the curing or yellowing schedule that new proportional, integral and derivative parameters will be continuously determined and actually inputted into the PID controller 10 for use in controlling the damper motor 12.

In order to continuously generate new proportional, integral and derivative functions during the curing process and effectively retune the PID controller 10, the tuning module 16 is programmed to effectively perform a tuning function continuously through the ramped cure such that it continuously redefines appropriate proportional, integral and derivative functions. This is accomplished by the following procedure.

Figure 3A:
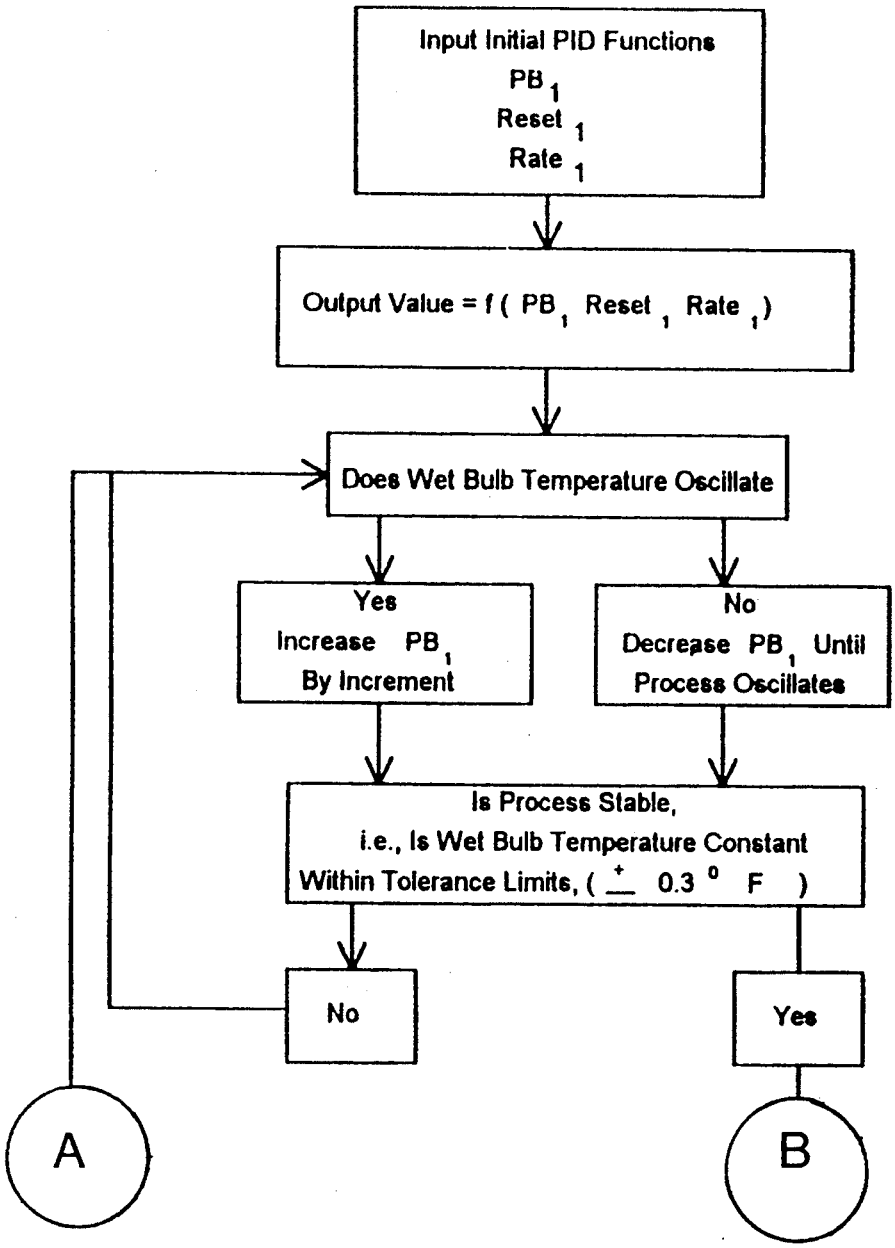
FIG. 3 is a schematic flow chart showing and illustrating the basic operation of the PID tuning module.
Figure 3B:
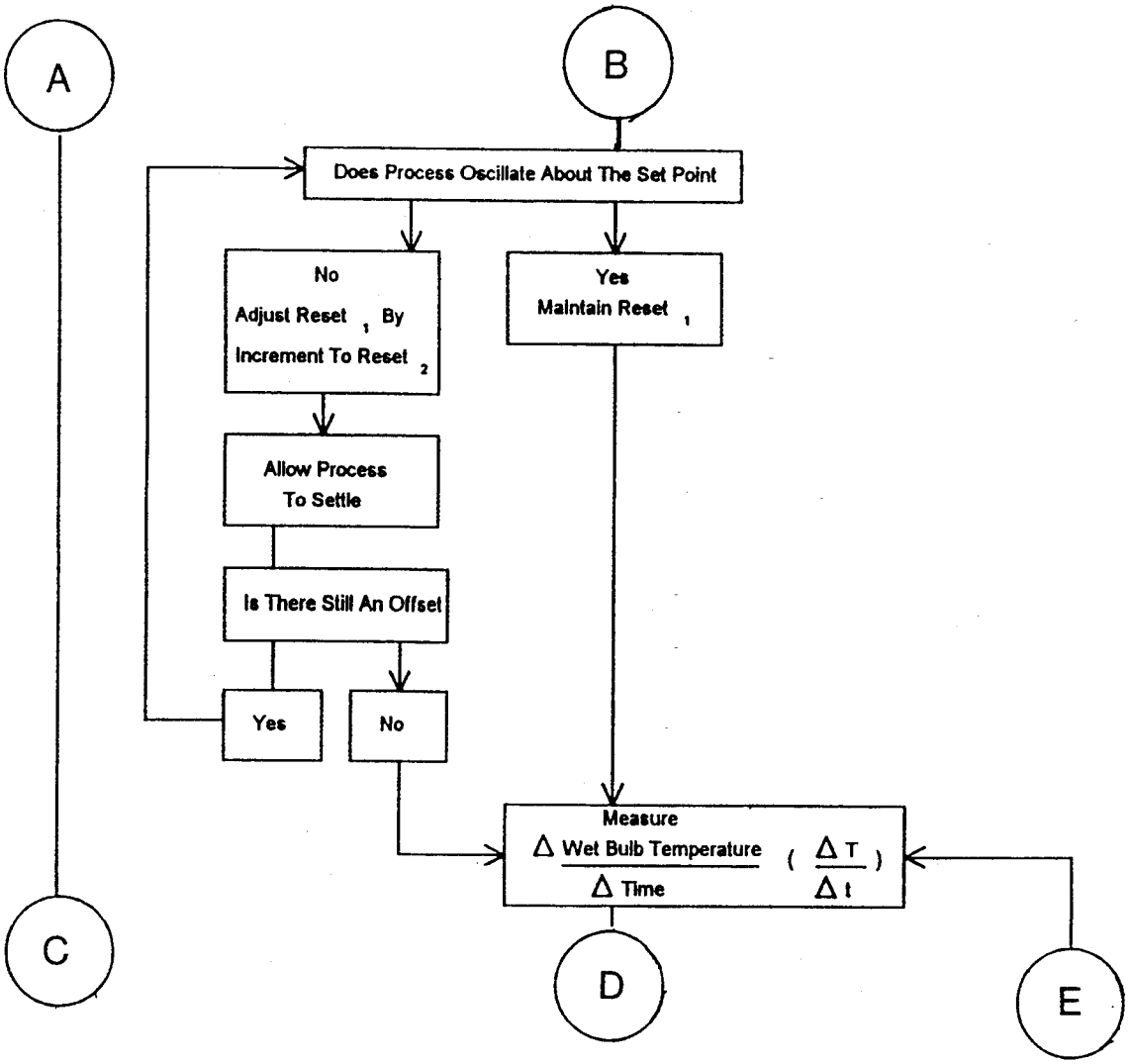
Figure 3C:
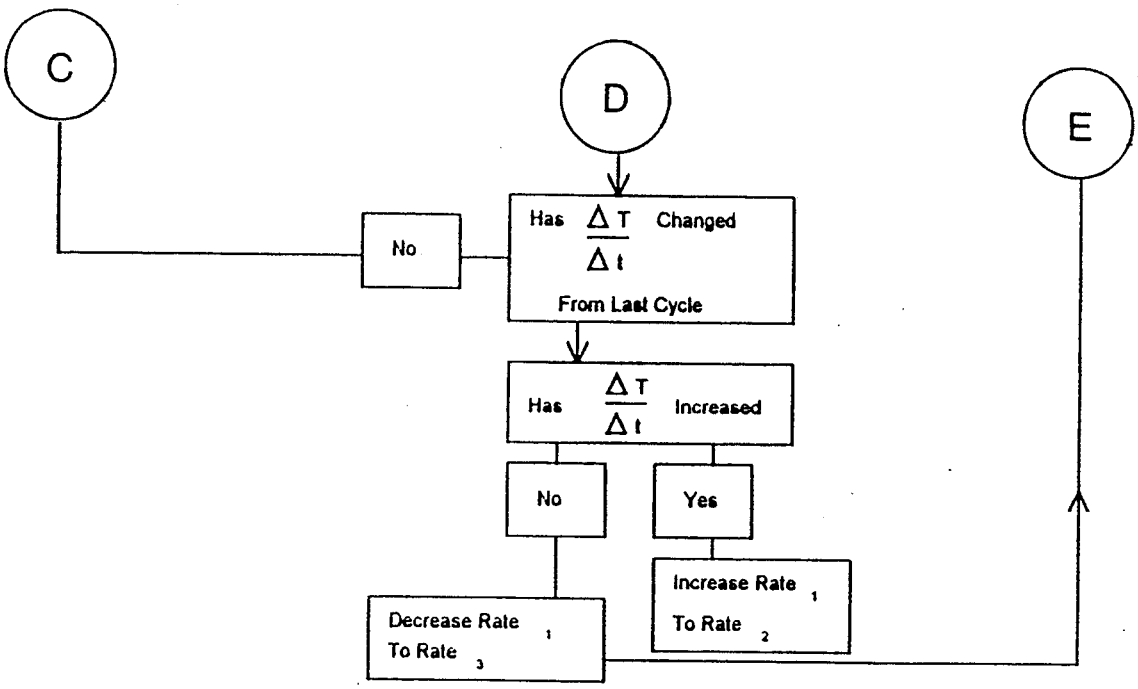

With reference to the flow chart of FIG. 3, it is seen that the basic tuning process is carried out as follows. First, the tuning module 16 is programmed to input initial PID functions into the damper controller 10. These PID functions are referred to $PB_1$, $reset_l$, and $rate_1$. It is understood that the proportional function is referred to as $PB_1$, the integral function is referred to as $reset_l$, and the derivative function is referred to as $rate_1$. Thus, the tuning module 16 will provide a value output which is a function of $PB_1$, $reset_1$, and $rate_1$, As the flow chart in FIG. 3 indicates, the first inquiry in the tuning and retuning process is "does the wet bulb temperature within the structure oscillate". If the answer to that question is yes then $PB_1$ is increased by a selected increment. If the answer is "no" to that inquiry, then $PB_1$ is decreased until the wet bulb temperature does in fact begin to oscillate.

Thereafter, the next inquiry into the process seeks to determine if the process is stable, that is, is the wet bulb temperature within the curing and drying structure essentially constant. If the answer to that inquiry is "no" then the control system is recycled back to the query "does the wet bulb temperature within the structure oscillate". If the answer is "yes" then the control process goes to the query "does the process or wet bulb temperature oscillate about the set point". If the answer to that inquiry is yes the reset function, $reset_1$, is maintained and the control system continues to move through the retuning process. If the answer is "no" then the process control adjusts $reset_1$ by a selected increment to $reset_2$. Basically, this part of the process is effectively shifting the offset and attempting to shift the set point such that the wet bulb temperature oscillates about the new or offset set point. But in any event, after the establishment of the new $reset_2$function, the process is allowed to settle. Once a selected settling time has passed, the process inquires as to whether there is still an offset. If the answer to that is "no" then the process continues through the tuning and retuning process. If there is still an offset and the answer is "yes" then the process returns to the inquiry "does the process oscillate about the new set point". This is continually repeated until a proper offset is established and it is determined that there is no offset.

At this point in the control process the proportional and integral values have been tuned and we now have a controller output that is a function of $PB_2$, $reset_2$, or possibly $reset_3$, reset4, etc. At this point, the rate function has not even changed and we are still dealing with a $rate_1$ function. To tune the rate function or the derivative function, the process measures the ratio of the change in wet bulb temperature to the change in time ($\Delta T/\Delta t$). Once this is done the process automatically increase $rate_1$ by a selected increments to $rate_2$. Then the process ask "does the ratio of the change in wet bulb temperature divided by the change in time ($\Delta T/\Delta t$) decrease". If this ratio does decrease then the process completely recycles to the first proportional band inquiry which ask "does the wet bulb temperature actually oscillate". Then the process control goes through the various steps described above and shown in the attached flow chart of FIG. 3.

If the ratio of the change in wet bulb temperature divided by the change in time does not decrease then the process is recycled through the rate retuning phase and a new rate, $rate_3$ is established and subjected to the same test.

It is appreciated that the above discussed control process is basically a software controlled process and that those skilled in the art can readily provide software that will carry out the above discussed process.

Another important function of the present invention entails re-establishing wet bulb temperature within the curing and drying structure in the event of a power failure. The system of the present invention includes a wet bulb temperature memory and reset module 15. In this regard, and in the case of a power failure, module 15 of the present invention automatically stores in memory the last wet bulb temperature maintained within the curing and drying structure. Once the power to the curing and drying structure has been reinstated, the control module 15 of the present invention will automatically re-establish the wet bulb temperature held in memory which happens to be the last recorded wet bulb temperature within the structure or on the program schedule prior to power failure.

Another feature of the present invention includes an alarm signal module 17, audible or visual, which is designed to emit a signal in response to the wet bulb temperature within the curing and drying structure falling outside of a selected range. This is, of course, a safety feature that would effectively apprise a farmer that the structure is not being appropriately controlled and that there is danger of damaging the crop or other agricultural product being subjected to curing or drying.

The present disclosure has discussed a bulk tobacco curing and drying process. For a more complete and unified understanding of a bulk tobacco curing process, one is referred to the disclosure of Larry J. Livingston found U.S. Pat. Nos. 5,125,420 and U.S. Pat. No. 4,836,222, the disclosures of which are expressly incorporated herein by reference. Also, during the course of this disclosure it has been stated that the PID tuning module 16 is capable of continuously tuning the PID values as the temperature is advanced within the curing and drying structure. It should be appreciated that the temperature that is being advanced can be either wet bulb or dry bulb temperature depending upon the particular control approach being utilized by the tobacco farmer.

From the foregoing specification and discussion, it is clear that the present invention entails a method and system for precisely controlling internal conditions and particularly wet bulb conditions within a curing and drying structure designed to cure and dry agricultural crops or products such as tobacco. Not only does the present process and system entail three-mode control, proportional, integral and derivative functions, the process and system continues to tune and re-tune these three parameters as the temperature is ramped during a selected phase or stage of the curing or drying process. Therefore, changes in outside environmental conditions as well as changes in the internal crop or product condition as well as other internal changes are automatically compensated for and the end result is that the curing and drying program is precisely controlled so as to optimize the process.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of curing tobacco comprising the steps of:

a) automatically advancing the dry bulb temperature within a tobacco curing structure over a selected period of time to yellow the tobacco;

b) sensing the wet bulb temperature within the tobacco curing structure and regulating the humidity within the curing and drying structure in accordance with dry bulb and wet bulb temperature by moving and controlling an inlet damper associated with the curing structure back and forth with respect to an air inlet opening and effectively controlling the amount of outside air directed into the structure and the amount of air exhausted from the curing structure;

c) the step of controlling the inlet damper including inputting the sensed wet bulb temperature to a controller including proportional, integral and derivative parameters for calculating, respectively, proportional, integral and derivative control signals and directing the proportional, integral, and derivative control signals to a damper controller that is effective to modulate the inlet damper; and d) continuously tuning and adjusting the proportional, integral and derivative parameters as the yellowing process progresses and as the dry bulb temperature is advanced in the curing and drying barn and continuously inputting these new and changing proportional, integral and derivative parameters into the damper controller such that as outside environmental conditions change the proportional, integral and derivative parameters change also and accordingly, the response of the damper to a change in wet bulb temperature will continually change through the yellowing process as the proportional, integral and derivative parameters change and are inputted into the damper controller.

2. The method of claim 1 including the step of establishing a predetermined range of acceptable wet bulb temperatures for the interior of the tobacco curing structure and sounding an alarm in response to the sensed wet bulb temperature lying outside that selected wet bulb temperature range.

3. The method of claim 1 including the step of constantly sensing the wet bulb temperature within the tobacco curing structure, and in the event of a power failure resulting in the curing process being shut down, restoring the last sensed wet bulb temperature within the tobacco curing structure when power is restored to the tobacco curing structure.

4. A variable three-mode curing and drying controller system for continuously controlling the moisture content of air being circulated through an agricultural product curing and drying structure by continuously varying and establishing new proportional, integral and derivative control parameters during the curing or drying process comprising: a) a damper controller connected to an inlet air damper of a curing and drying structure for controlling the amount of fresh outside air induced into the structure and consequently controlling the amount of inside air exhausted from the same tobacco curing structure; b) a wet bulb thermometer for sensing wet bulb temperatures within the curing structure and connected to the damper controller for directing wet bulb temperature signals to the damper controller;

c) a proportional, integral, and derivative sub-controlled system forming a part of the damper controller, the subcontrolled system including proportional, integral and derivative parameters for calculating and outputting, respectively, proportional, integral and derivative control signals to the inlet damper of the curing structure; and d) a proportional, integral and derivative signal tuning module coupled to the damper controller for continuously establishing new and varied proportional, integral and derivative parameters and inputting the changing proportional, integral and derivative parameters into the damper controller such that the response of the inlet damper to a particular control signal from the damper controller varies as outside and inside conditions change.

5. The variable three-mode curing and drying damper control system of claim 4 including an alarm for emitting an alarm signal in response to the sensed wet bulb temperature being outside of a selected range of wet bulb temperatures.

6. The variable three-mode curing and drying damper control system of claim 4 including a wet bulb temperature reset controller for automatically re-establishing wet bulb temperature to the last sensed wet bulb temperature within the curing and drying structure prior to a power failure in response to power being re-established to the control system.

7. The control system of claim 4 including a temperature advance control for advancing the temperature within the curing and drying structure up a temperature ramp and wherein the tuning module is programmed to continuously tune and retune the proportional, integral and derivative values as the temperature is controlled and ramped in the structure.

8. A method of curing and drying an agricultural product comprising the steps of:

a) automatically advancing the temperature within a structure having the agricultural product therein over a selected period of time to dry the agricultural product;

b) sensing the wet bulb temperature within the structure;

c) regulating the humidity within the structure in accordance with the wet bulb temperature by moving and controlling an inlet damper associated with the structure back and forth with respect to the air inlet opening and effectively controlling the amount of outside air directed into the structure and the amount of air exhausted from the structure;

d) the step of controlling the inlet damper including inputting the sensed wet bulb temperature o a controller including proportional, integral and derivative parameters for calculating, respectively, proportional, integral and derivative control signals and directing the proportional, integral and derivative control signals to a damper controller that is effective to modulate the inlet damper; and e) continuously tuning and adjusting the proportional, integral and derivative parameters as the process progresses and as the temperature is advanced in the structure and continuously inputting these new and changing proportional, integral and derivative parameters into the damper controller such that as outside environmental conditions change the proportional, integral and derivative parameters change also and accordingly the response of the damper to a change in wet bulb temperature will continually change through the process as the proportional, integral and derivative parameters change and are inputted into the damper controller.

* * * * *